US008368492B1

(12) United States Patent
Theisen et al.

(10) Patent No.: US 8,368,492 B1
(45) Date of Patent: Feb. 5, 2013

(54) BIDIRECTIONAL DIRECT CURRENT ELECTRICAL SWITCHING APPARATUS

(75) Inventors: Peter J. Theisen, West Bend, WI (US); Paul J. Rollmann, Brown Deer, WI (US); Mark A. Juds, New Berlin, WI (US); Xin Zhou, Franklin Park, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/593,867

(22) Filed: Aug. 24, 2012

(51) Int. Cl.
*H01H 9/30* (2006.01)
*H01H 9/38* (2006.01)
*H01H 9/44* (2006.01)
*H01H 33/12* (2006.01)

(52) U.S. Cl. ..... 335/201; 218/15; 218/34

(58) Field of Classification Search ..... 335/78, 335/131, 201; 200/10; 218/15, 34
See application file for complete search history.

(56) References Cited

U.S. PATENT DOCUMENTS 1,963,643 A * 6/1934 Brainard et al. ..... 218/149
2,901,579 A * 8/1959 Simpson, Jr. ..... 218/28
3,621,169 A * 11/1971 Heft et al. ..... 218/152
4,562,418 A * 12/1985 Bachler ..... 335/131
4,618,751 A * 10/1986 Wehr et al. ..... 218/151
5,003,137 A * 3/1991 Tateishi et al. ..... 218/151
5,004,874 A 4/1991 Theisen et al.
5,130,504 A 7/1992 Moldovan et al.
5,138,122 A * 8/1992 Moldovan et al. ..... 218/22
5,223,681 A * 6/1993 Buehler et al. ..... 218/22
5,418,511 A * 5/1995 Theisen et al. ..... 335/201
7,830,232 B2 * 11/2010 Grahor et al. ..... 335/201
2011/0090607 A1 4/2011 Luebke et al.
2011/0141644 A1 6/2011 Hastings et al.
2011/0301772 A1 12/2011 Zuercher et al.

* cited by examiner

*Primary Examiner* — Alexander Talpalatski
(74) *Attorney, Agent, or Firm* — Eckert Seamans Cherin & Mellott, LLC; Kirk D. Houser

(57) ABSTRACT

A direct current electrical switching apparatus includes a first contact in electrical communication with first and third arc runners, a second contact in electrical communication with second and fourth arc runners, a movable contact, a first arc chamber including first arc plates having a first width, a second arc chamber including second arc plates having a greater second width, an operating mechanism, and a magnet assembly cooperating with the arc chambers to establish generally oppositely directed magnetic fields. The magnetic fields cause one of a first arc and a second arc to enter one of the arc chambers depending upon a direction of current flow between the contacts. The electrical switching apparatus is rated for a first magnitude of current flowing from the first contact to the second contact and for a greater second magnitude of opposite second current flowing from the second contact to the first contact.

10 Claims, 6 Drawing Sheets

BIDIRECTIONAL DIRECT CURRENT ELECTRICAL SWITCHING APPARATUS

BACKGROUND

1. Field

The disclosed concept pertains generally to electrical switching apparatus and, more particularly, to bidirectional direct current electrical switching apparatus, such as, for example, bidirectional direct current relays and circuit breakers.

2. Background Information

Plural parallel strings of series-connected direct current (DC) electrical generating modules (e.g., without limitation, photovoltaic (PV) or solar generating modules) can employ a fuse located in the positive conductor of each string. The fuse only protects against a reverse over current when the corresponding string shorts and is back fed by the other PV strings which are bussed together at a main DC bus in a combiner box.

It is known to employ fuses for over current protection in combination with diodes to block reverse current.

It is believed that fuses are essentially useless in PV power systems since such fuses are sized at 125% and typically must open at 150% of full load current, while the maximum short circuit current for PV arrays does not significantly exceed 100% of full load current. In PV power systems, fuses protect conductors, such as wires, from over currents. Over currents can only result from a back feed condition. Formed feed currents for silicon PV modules are typically limited to about 7.5 A by the structure of the PV modules, which cannot produce more than about 7.5 A even when short circuited. Therefore, string fuses are useless for providing protection from a forward feed fault, or bus faults that occur above the string fuses.

In a PV generating system, the parallel strings of series-connected DC electrical generating modules supply DC power to the main DC bus in the combiner box. A substantial reverse over current can be caused when one of the strings shorts and is back fed by the other PV strings which are bussed together at the main DC bus. The reverse over current is the greatest when the short occurs just prior to the last DC electrical generating module in a string.

There is room for improvement in bidirectional electrical switching apparatus.

SUMMARY

There is a desire to provide arc extinction (circuit interruption) at relatively high DC voltages (e.g., without limitation, 300 VDC to 1500 VDC), at relatively low forward currents (e.g., without limitation, about 1 A to about 10 A), and at relatively higher reverse currents (e.g., without limitation, up to about 300 A).

This need and others are met by embodiments of the disclosed concept in which a direct current electrical switching apparatus comprises: a first arc runner; a second arc runner; a third arc runner; a fourth arc runner; a first contact in electrical communication with the first and third arc runners; a second contact in electrical communication with the second and fourth arc runners; a movable contact comprising a first portion and a second portion respectively cooperating with the first contact and the second contact to provide a closed contact position in which the movable contact electrically engages the first and second contacts, and an open contact position in which the movable contact is disengaged from the first and second contacts; a first arc chamber comprising a first end, an opposite second end, a first longitudinal axis therebetween, and a plurality of first arc plates between the first end and the opposite second end, the first arc plates having a first width measured in a direction normal to the first longitudinal axis, one of the first arc plates at the first end of the first arc chamber being proximate the first arc runner, another one of the first arc plates at the opposite second end of the first arc chamber being proximate the second arc runner; a second arc chamber comprising a first end, an opposite second end, a second longitudinal axis therebetween, and a plurality of second arc plates between the first end and the opposite second end of the second arc chamber, the second arc plates having a second width measured in a direction normal to the second longitudinal axis, one of the second arc plates at the first end of the second arc chamber being proximate the third arc runner, another one of the second arc plates at the opposite second end of the second arc chamber being proximate the fourth arc runner; an operating mechanism cooperation with the movable contact to move the movable contact between the closed contact position and the open contact position; and a magnet assembly cooperating with the first and second arc chambers to establish generally oppositely directed magnetic fields normal to the first and second longitudinal axes, normal to a first direction of a first arc between the first contact and the first portion of the movable contact as the movable contact moves away from the closed contact position toward the open contact position, and normal to an opposite second direction of a second arc between the second contact and the second portion of the movable contact as the movable contact moves away from the closed contact position toward the open contact position, in order that the generally oppositely directed magnetic fields cause one of the first arc and the second arc to enter one of the first and second arc chambers, respectively, depending upon a direction of current flow between the first contact and the second contact, wherein the electrical switching apparatus is rated for a first magnitude of first current flowing from the first contact through the movable contact to the second contact and for a second magnitude of opposite second current flowing from the second contact through the movable contact to the first contact; wherein the second magnitude is greater than the first magnitude; and wherein the second width is greater than the first width.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
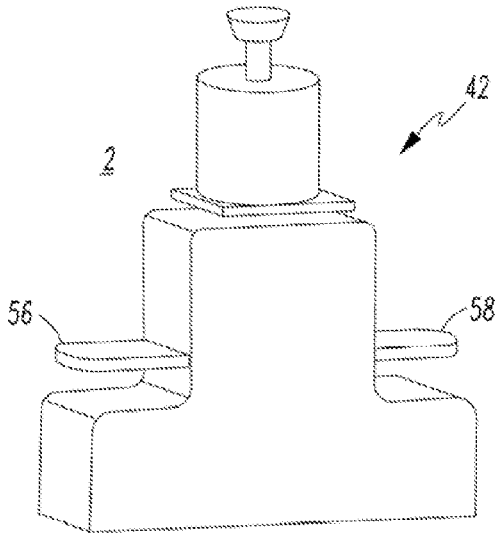
FIG. 1 is an isometric view of a relay in accordance with embodiments of the disclosed concept.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with a relay, although the disclosed concept is applicable to a wide range of electrical switching apparatus, such as circuit breakers.

Referring to FIGS. 1-5, a direct current electrical switching apparatus, such as the example relay 2 is shown. The relay 2 includes a first arc runner 4, a second arc runner 6, a third arc runner 8, and a fourth arc runner 10. A first (stationary) contact 12 is in electrical communication with the first and third arc runners 4,8. A second (stationary) contact 14 is in electrical communication with the second and fourth arc runners 6,10. A U-shaped (partially shown in FIGS. 4 and 5) movable contact 16 includes a first portion 18 (best shown in FIG. 4) and a second portion 20 (best shown in FIG. 5) respectively cooperating with the first contact 12 and the second contact 14 to provide a closed contact position (not shown, but see the armature position of points B, C, D and E of FIG. 9; points C and D represent the closed contact position; points B and E represent the initial contact touch position) in which the movable contact 16 electrically engages the first and second contacts 12,14, and an open contact position (shown in FIGS. 4 and 5) in which the movable contact 16 is disengaged from the first and second contacts 12,14. The movable contact 16 bridges between the two sides of the example relay 2. The two stationary contacts 12,14 are on the arc runners 4,10 in the arc chambers 22,32, respectively.

A first arc chamber 22 includes a first end 24, an opposite second end 26, a first longitudinal axis 28 therebetween, and a plurality of first arc plates 30 between the ends 24,26. The first arc plates 30 have a first width 31 measured in a direction normal to the first longitudinal axis 28. One 30A of the first arc plates 30 at the first end 24 of the first arc chamber 22 is proximate the first arc runner 4. Another one 30B of the first arc plates 30 at the opposite second end 26 of the first arc chamber 22 is proximate the second arc runner 6. A second arc chamber 32 includes a first end 34, an opposite second end 36, a second longitudinal axis 38 therebetween, and a plurality of second arc plates 40 between the first end 34 and the opposite second end 36 of the second arc chamber 32. The second arc plates 40 have a second width 41 measured in a direction normal to the second longitudinal axis 38. One 40A of the second arc plates 40 at the first end 34 of the second arc chamber 32 is proximate the third arc runner 8. Another one 40B of the second arc plates 40 at the opposite second end 36 of the second are chamber 32 is proximate the fourth arc runner 10.

Figure 4:
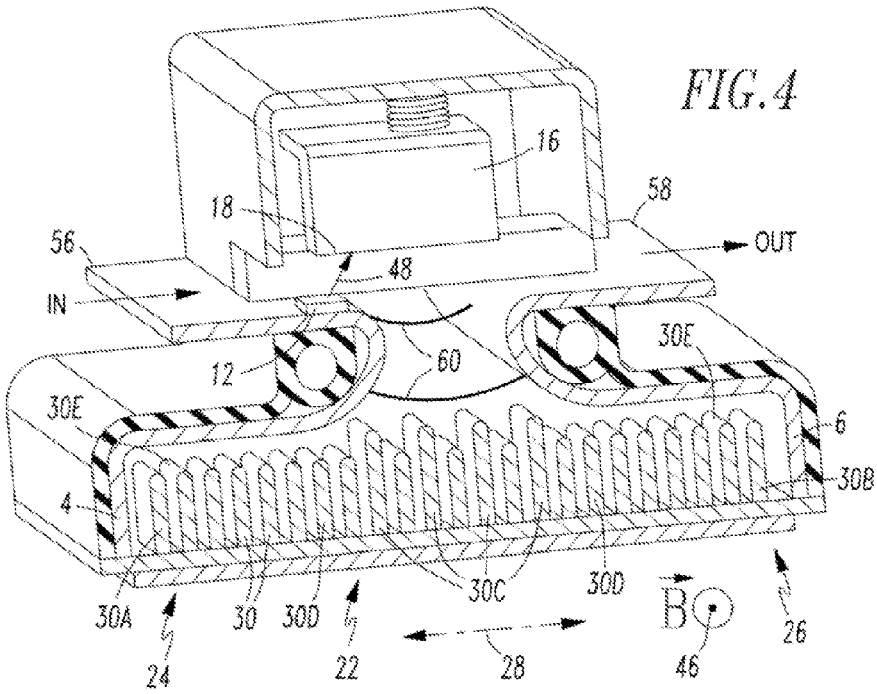
FIG. 4 is a front isometric view of the relay of FIG. 1 with a front portion cut-away to show internal structures.
Figure 5:
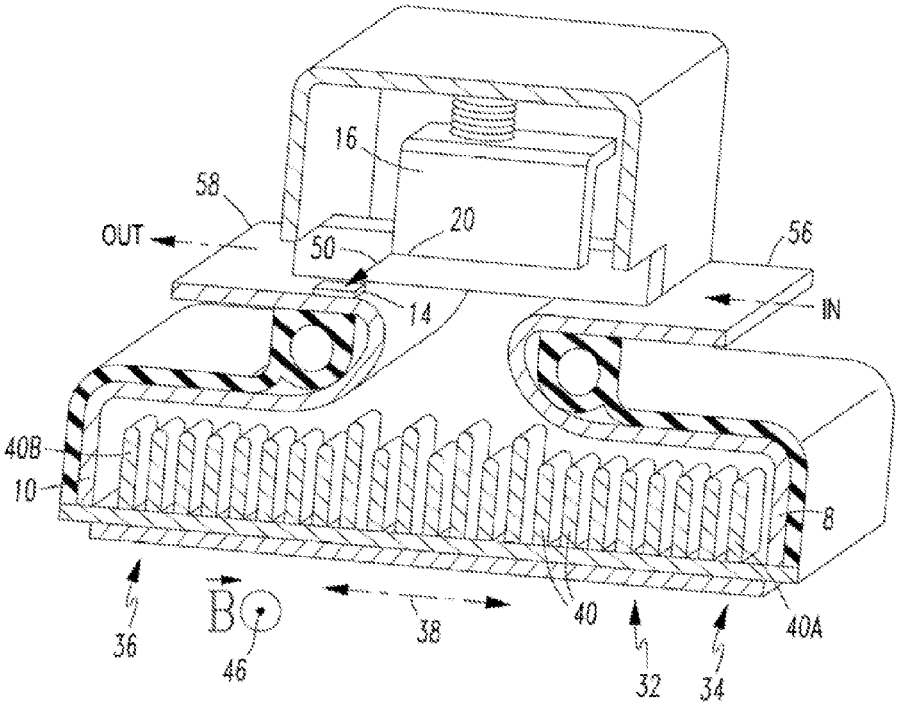
FIG. 5 is a rear isometric view of the relay of FIG. 1 with a rear portion cut-away to show internal structures.

An operating mechanism 42 (best shown in FIG. 6) cooperates with the movable contact 16 to move the movable contact 16 between the closed contact position and the open contact position. A magnet assembly 44 cooperates with the first and second arc chambers 22,32 to establish generally oppositely directed magnetic fields 46 normal to the first and second longitudinal axes 28,38, normal to a first direction of a first arc 48 between the first contact 12 and the first portion 18 of the movable contact 16 as the movable contact 16 moves away from the closed contact position toward the open contact position, and normal to an opposite second direction of a second arc 50 between the second contact 14 and the second portion 20 of the movable contact 16 as the movable contact 16 moves away from the closed contact position toward the open contact position, in order that the generally oppositely directed magnetic fields 46 cause one of the first arc 48 and the second arc 50 to enter one of the first and second arc chambers 22,32, respectively, depending upon a direction of current flow between the first contact 12 and the second contact 14. In FIGS. 4 and 5, the generally oppositely directed magnetic fields 46 are into or out of the drawing page.

As will be described, the example relay 2 is rated for a first magnitude of first current flowing from the first contact 12 through the movable contact 16 to the second contact 14 and for a second magnitude of opposite second current flowing from the second contact 14 through the movable contact 16 to the first contact 12. The second magnitude is greater than the first magnitude. The second width 41 is greater than the first width 31.

Figure 2:
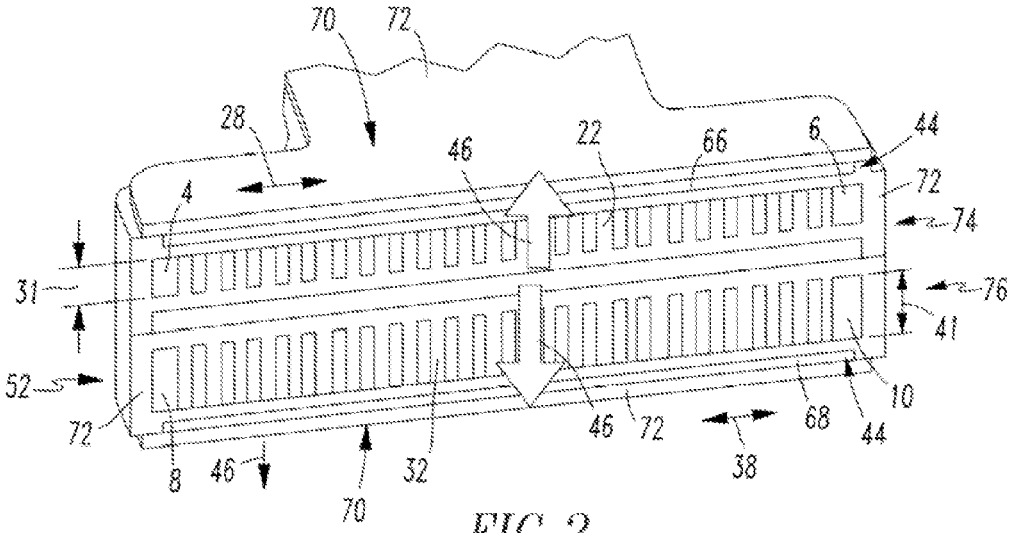
FIG. 2 is a bottom isometric view of the relay of FIG. 1 with a bottom portion cut-away to show internal structures.
Figure 3:
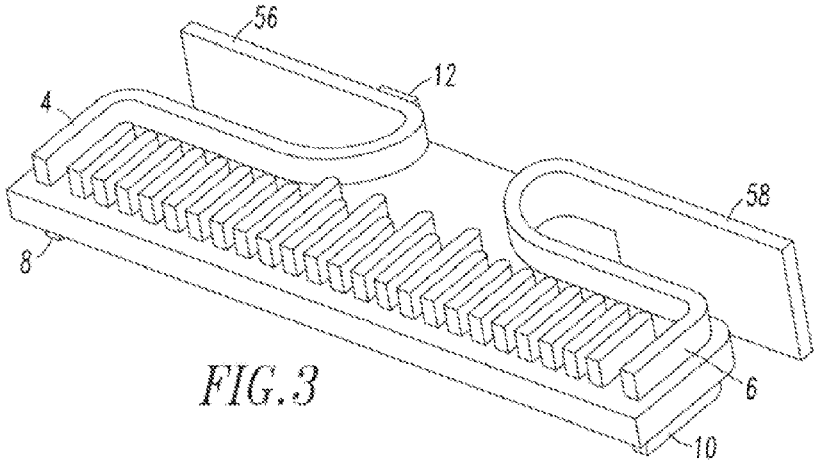
FIG. 3 is an isometric view of the arc runners and portions of the arc chambers of the relay of FIG. 2.

A dual arc chamber 52 includes a first relatively narrow portion corresponding to the first arc chamber 22 and a second relatively wider portion corresponding to the second arc chamber 32 as best shown in FIG. 2. Each of the first and second arc chambers 22 and 32 comprises the plural, parallel arc plates 30 and 40 disposed between the arc runners 4,6 and 8,10, respectively. The arc runners 4,8 are electrically connected to each other and to the first contact 12 and power terminal 56, and the arc runners 6,10 are electrically connected to each other and to the second contact 14 and power terminal 58 as shown in FIGS. 3-5. The movable contact 16 is carried by a magnetic latching actuator 54 (best shown in FIG. 6) and includes the first and second portions 18,20 that respectively electrically engage the first and second contacts 12,14 in the closed position to close the relay 2, and that respectively electrically disconnect from the first and second contacts 12,14 to open the relay 2.

The first power terminal 56 is electrically connected to the positive side of a high voltage DC power supply (not shown), and the second power terminal 58 is electrically connected to the negative side of that DC power supply (not shown). The magnetic field 46 across the first arc chamber 32 is directed out of the drawing page of FIG. 4. Upon separation, the two arcs 48,50 are respectively drawn between first contact 12 and the first movable contact portion 18 and between the second movable contact portion 20 and second contact 14. The two arcs 48,50 tend to expand and the force applied by the generally oppositely directed magnetic fields 46 in the respective arc chambers 22,32 move the first arc 48 rightward (with respect to FIG. 4) along movable contact 16 toward the surface of opposite arc runner 6. The anode end of the first arc 48 moves around a short radius corner of the arc runner 4. Because an anode end of an arc moves more readily than does a cathode end of the arc, it is preferable that the anode end be that which traverses a more irregular surface, while the cathode end move along the flat surface of the movable contact 16.

While first arc 48 is lengthening and increasing the voltage thereof, the opposite second arc 50 is also moving rightward (with respect to FIG. 4 or leftward with respect to FIG. 5) under the bias of the magnetic field 46 in the opposite arc chamber 32 but within a more confined area. Within a small interval of time, the first arc 48 attaches to the opposite arc runner 6 within the first arc chamber 22 common to first contact 12, establishes a current path through first arc 48 from the arc runner 4 to the arc runner 6, and therefore from the power terminal 56 to the power terminal 58.

Inasmuch as arc runner 8 in the rear arc chamber 32 is common and electrically connected to the arc runner 4 in the forward arc chamber 22 to which first contact 12 is electrically connected, the current path previously extending to the movable contact 16 from arc runner 4 and from the movable contact 16 to arc runner 8 is now eliminated and the second arc 50 is eliminated as well. Thereafter, a single arc 60 (FIG. 4) progresses along the surfaces of the two arc runners 4,6 within the forward arc chamber 22 (with respect to FIG. 4) downward (with respect to FIG. 4) into the arc splitter plates 30. The arc 60 continues to move along the arc runners 4 and 6 driven by the corresponding permanent magnetic field 46, thereby lengthening and moving in proximity of the splitter plates 30. The arc 60 is first separated into intermediate length segments between the adjacent depending ends of arc plates 30C, and between arc plates 30C and 30D, and thereafter is split into smaller lengths as these segments move into the smaller gaps between splitter plates 30E and the adjacent splitter plates 30E, 30D or 30C. Once the arc is within the splitter plates 30A,30E,30D,30C,30D,30E,30B, the increased arc voltage levels drive the arc current to zero to interrupt the DC power circuit.

For forward current, the generally oppositely directed magnetic fields 46 cause the first arc 48 to enter the first arc chamber 22 and cause the second arc 50 to avoid the second arc chamber 32. However, when the polarity of the DC current is reversed, the generally oppositely directed magnetic fields 46 cause the first arc 48 to avoid the first arc chamber 22 and cause the second arc 50 to enter the second arc chamber 32.

Referring to FIGS. 2-5, the magnet assembly 44 includes a first permanent magnet 66, a second permanent magnet 68, ferromagnetic frames 70, and an insulative case 72 including a first portion 74 holding the first arc chamber 22, and a second portion 76 holding the second arc chamber 32. The insulative case 72 partially surrounds the first and second arc chambers 22,32, and then is covered by the ferromagnetic frames 70.

The first permanent magnet 66 has a magnetic polarity (S) facing the first arc chamber 22, and the second permanent magnet 68 has the same magnetic polarity (S) facing the second arc chamber 32. This results in the generally oppositely directed magnetic fields 46 in each arc chamber 22,32.

EXAMPLE 1

An example voltage between the first and second power terminals 56,58 can be up to about 800 VDC. DC solar string and combiner box applications can employ a miniature relay or circuit breaker to replace fuses and provide a tripable/resetable device that can incorporate solar arc fault algorithms. A single electrical switching apparatus, such as the relay 2, can address about 600 VDC to about 750 VDC applications, while two such relays 2 in series can address about 1000 VDC to about 1500 VDC applications.

For a 600 VDC solar string protector, such as a relay or miniature circuit breaker, the forward current through the string is less than about 7.5 A at a forward 600 DC voltage, and hence the string protector is rated at 10 A and 600 VDC forward voltage. However, the reverse short circuit fault current can be much greater and the string protector is rated at 300 A and 600 VDC reverse voltage. As a result, the first relatively narrow portion of the first arc chamber 22 is provided for the first arc 48 corresponding to interruption of the forward current (FIGS. 2 and 4), and the second relatively wider portion of the second arc chamber 32 is provided for the second arc 50 (shown in the opposite direction for forward current) corresponding to interruption of the relatively much larger reverse current (FIGS. 2 and 5).

The magnitude of the forward current can be about 10 DC amperes, and the magnitude of the opposite reverse current can be about 300 DC amperes. In that instance, the second width 41 is about three times greater than the first width 31.

EXAMPLE 2

Figure 6:
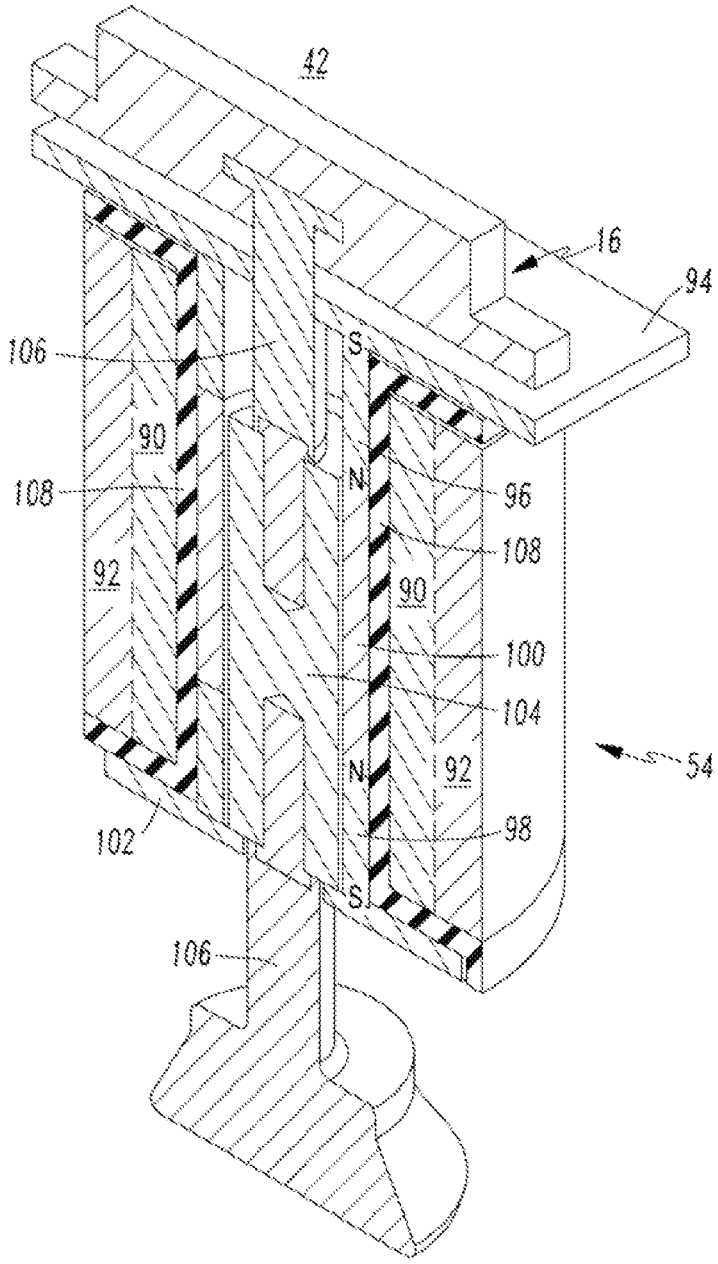
FIG. 6 is a cross-sectional isometric view of the latching magnetic actuator of the relay of FIG. 1.
Figure 7:
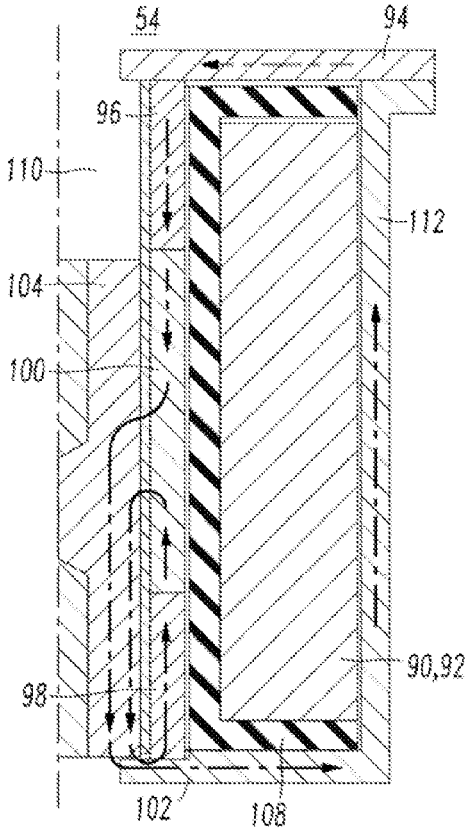
FIGS. 7 and 8 are cross-sectional vertical elevation views of a portion of the latching magnet actuator of FIG. 6.
Figure 8:
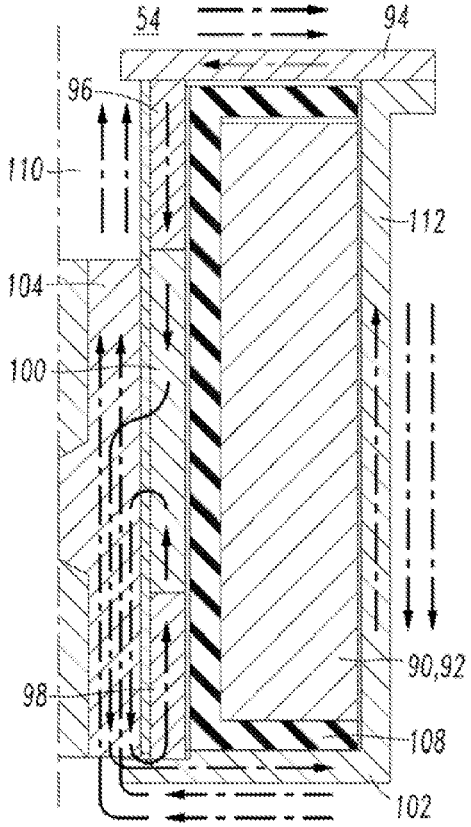

The operating mechanism 42 is the example latching magnetic actuator 54. The magnetic actuator 54 includes two coils 90,92 and provides magnetic latching. As shown in FIGS. 6-8, the magnetic latching actuator 54 includes a top steel plate 94, two permanent magnets 96,98, a steel tube 100, a bottom steel frame 102, and a steel armature 104 coupled to a non-magnetic pin or screw 106 coupled to the movable contact 16. A bobbin 108 carries the two coils 90,92.

Figure 9:
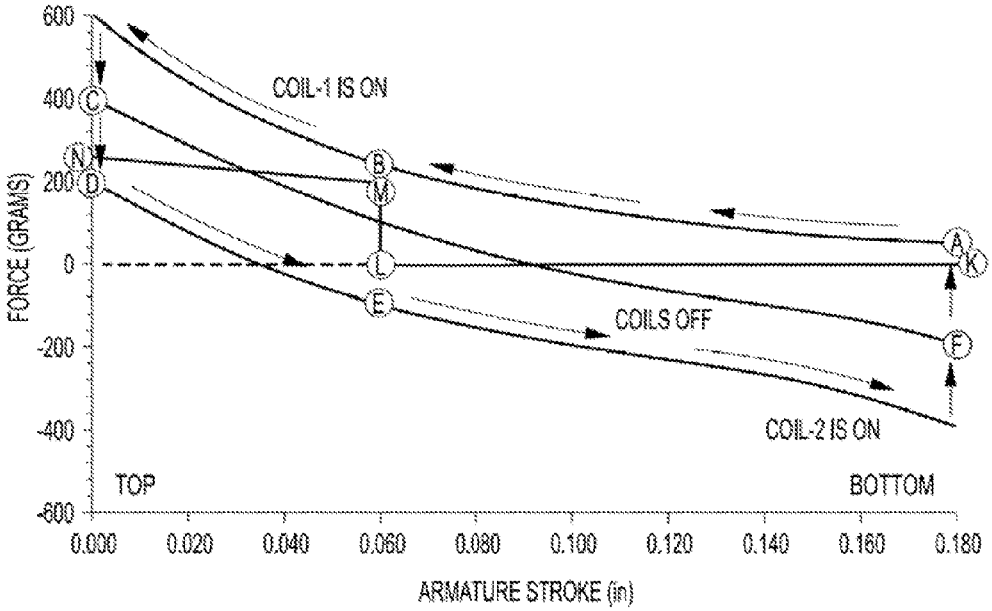
FIG. 9 is a plot of force versus armature stroke for the latching magnetic actuator of FIG. 6.

As shown in FIG. 9, the first coil 90 is turned on and raises the magnetic force from point F to point A (above the contact spring force at point K). Then, the armature 104 moves upward (FIG. 8). At point B, the magnetic force on the armature 104 with the first coil 90 turned on is greater than the spring force at M, for example and without limitation, 200 grams to overcome the contact spring force for the movable contact 16. At point C, the first coil 90 is turned off and the upward hold force to latch the relay 2 closed is produced by the magnetic flux from the permanent magnets 96,98 (FIG. 7). The top curve (A to B to 600) represents the force versus stroke with the first coil 90 (COIL-1) turned on. The bottom curve (D to E to −400) represents the force versus stroke with the second coil 92 (COIL-2) turned on. The smooth center curve (C to F) represents the force versus stroke with both coils 90,92 turned off. The straight segmented center curve (K to L to M to N) represents the contact spring forces in the system.

When the second coil 92 is turned on, this lowers the net magnetic force to point D (below the contact spring force at point N). As a result, the armature 104 moves downward. At point E, the net magnetic force is less than the contact spring force at point L (0 grams) (i.e., is in a negative direction, which is downward with respect to FIG. 8). Finally, the second coil 92 is turned off and the downward hold force to latch the relay 2 open is produced by the magnetic flux from permanent magnets 96,98 at point F.

FIGS. 7 and 8 show the magnetic flux from the permanent magnets 96,98 and the magnetic flux from the coil 90 to explain how the armature 104 is latched at the bottom (with respect to FIG. 7), and how it is un-latched and made to move up to the top (with respect to FIG. 8). Initially, in FIG. 7, the two coils 90,92 are off at point F of FIG. 9 The magnetic flux from each permanent magnet 96,98 is shown as a dashed line with an arrow head. The armature top air gap 110 receives no permanent magnet flux, while the armature 104 and the bottom air gap (FIG. 7) receive two times the permanent magnet flux.

Reversing the process (which is equivalent to holding FIGS. 7 and 8 upside down) explains how the armature 104 is latched at the top (with respect to FIG. 7), and how it is un-latched and made to move down to the bottom (with respect to FIG. 8). At point A of FIG. 9, the first coil 90 is on. The magnetic flux from coil 90 (FIG. 8) is shown as two dashed lines with arrow heads, in the opposite direction to the permanent magnet flux. The armature 104 top (with respect to FIG. 8) air gap 110 receives twice the permanent magnet flux from the first coil 90 less no permanent magnet flux for a net twice the permanent magnet flux upward (with respect to FIG. 8). The armature 104 and the bottom air gap receive twice the permanent magnet flux (upward from the first coil 90 with respect to FIG. 8) less twice the downward (with respect to FIG. 8) permanent magnet flux for a net zero magnetic flux. The steel armature 104 carries twice the permanent magnet flux in the downward direction in FIG. 7, and a net of twice the permanent magnet flux in the upward direction in FIG. 8. The steel parts (top steel plate 94, bottom steel frame 102 and legs 112 of the steel frame 102) carry one permanent magnet flux in the counter-clockwise direction in FIG. 7, and a net of one permanent magnet flux in the clockwise direction in FIG. 8.

The flux in the permanent magnets 96,98 is constant and does not significantly change. The coil amp-turns (N1) causes the permanent magnet flux to transfer from the armature bottom air gap to the top air gap 110, and causes the net magnetic flux in the steel parts to change direction (armature 104, top steel plate 94, bottom steel frame 102, and legs 112 of the steel frame 102). Transferring the permanent magnet flux to a different path requires far less energy than changing the magnetization direction of the permanent magnets.

Alternatively, a single coil configuration (not shown) employs a power source (not shown) connected "+ or −" for movement in one direction, and connected "− to +" for movement in the opposite direction.

Otherwise, the two coils 90,92 are employed, one coil at a time. The first coil 90 produces magnetic flux upward through the armature 104 to get the armature 104 to move upward (with respect to FIG. 7). The second coil 92 produces magnetic flux downward (with respect to FIG. 7) through the armature to get the armature 104 to move downward (with respect to FIG. 7). If the armature 104 pole face area is different at the top and bottom (with respect to FIG. 7), then the latching force will be different at the top and bottom (with respect to FIG. 7). Then, the two coils 90,92 could be different to produce different forces in the upward and downward (with respect to FIG. 7) directions.

EXAMPLE 3

The disclosed concept provides intrinsic bidirectional, relatively low DC switching, with no minimum interruption current. The arc runners 4,6,8,10 and arc plates 30,40 arrangement provide effective arc splitting and minimal back-striking. The magnetic field design of the dual arc chamber 52 defines a stable final split are position, with negligible arc flash.

EXAMPLE 4

Although a relay is shown, it will be appreciated that a circuit breaker can employ the disclosed dual arc chamber 52, fixed contacts 10,12 and arc runners 4,6,8,10. For example and without limitation, a minimized arc chamber 22,32 achieves relatively higher voltage (e.g., without limitation, up to 1500 VDC; 750 VDC for one unit) DC switching in a miniature DC switching device, such as a circuit breaker, the example relay 2, a contactor, or it switch.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A direct current electrical switching apparatus comprising:

a first arc runner, a second arc runner;

a third arc runner;

a fourth arc runner;

a first contact in electrical communication with said first and third arc runners;

a second contact in electrical communication with said second and fourth arc runners;

a movable contact comprising a first portion and a second portion respectively cooperating with said first contact and said second contact to provide a closed contact position in which said movable contact electrically engages said first and second contacts, and an open contact position in which said movable contact is disengaged from said first and second contacts;

a first arc chamber comprising a first end, an opposite second end, a first longitudinal axis therebetween, and a plurality of first arc plates between the first end and the opposite second end, said first arc plates having a first width measured in a direction normal to said first longitudinal axis, one of the first arc plates at the first end of the first arc chamber being proximate said first arc runner, another one of the first arc plates at the opposite second end of the first arc chamber being proximate said second arc runner;

a second arc chamber comprising a first end, an opposite second end, a second longitudinal axis therebetween, and a plurality of second arc plates between the first end and the opposite second end of the second arc chamber, said second arc plates having a second width measured in a direction normal to said second longitudinal axis, one of the second arc plates at the first end of the second arc chamber being proximate said third arc runner, another one of the second arc plates at the opposite second end of the second arc chamber being proximate said fourth arc runner;

an operating mechanism cooperating with said movable contact to move said movable contact between the closed contact position and the open contact position; and a magnet assembly cooperating with said first and second arc chambers to establish generally oppositely directed magnetic fields normal to the first and second longitudinal axes, normal to a first direction of a first arc between said first contact and the first portion of said movable contact as said movable contact moves away from the closed contact position toward the open contact position, and normal to an opposite second direction of a second arc between said second contact and the second portion of said movable contact as said movable contact moves away from the closed contact position toward the open contact position, in order that said generally oppositely directed magnetic fields cause one of the first arc and the second arc to enter one of said first and second arc chambers, respectively, depending upon a direction of current flow between the first contact and the second contact, wherein said electrical switching apparatus is rated for a first magnitude of first current flowing from said first contact through said movable contact to said second contact and for a second magnitude of opposite second current flowing from said second contact through said movable contact to said first contact;

wherein said second magnitude is greater than said first magnitude; and wherein said second width is greater than said first width.

2. The electrical switching apparatus of claim 1 wherein said electrical switching apparatus is a relay.

3. The electrical switching apparatus of claim 2 wherein said operating mechanism is a latching magnetic actuator.

4. The electrical switching apparatus of claim 1 wherein the first magnitude of the first current is about 10 amperes; and wherein the second magnitude of the opposite second current is about 300 amperes.

5. The electrical switching apparatus of claim 1 wherein said second width is about three times greater than said first width.

6. The electrical switching apparatus of claim 1 wherein a voltage of said first arc or said second arc is about 800 VDC.

7. The electrical switching apparatus of claim 1 wherein the first direction of the first arc between the first contact and the first portion of the movable contact as said movable contact moves away from the closed contact position toward the open contact position is from the first contact to the first portion of said movable contact; wherein the opposite second direction of the second arc between the second contact and the second portion of the movable contact as said movable contact moves away from the closed contact position toward the open contact position is from the second portion of said movable contact to the second contact; and wherein said generally oppositely directed magnetic fields cause the first arc to enter the first arc chamber and cause the second arc to avoid the second arc chamber.

8. The electrical switching apparatus of claim 1 wherein said magnet assembly comprises a first permanent magnet, a second permanent magnet, ferromagnetic frames and an insulative case including a first portion holding said first arc chamber, and a second portion holding said second arc chamber.

9. The electrical switching apparatus of claim 8 wherein the insulative case partially surrounds the first and second arc chambers.

10. The electrical switching apparatus of claim 8 wherein said first permanent magnet has a magnetic polarity facing the first arc chamber; and wherein said second permanent magnet has the same magnetic polarity facing the second arc chamber.

* * * * *